US008672658B2

(12) United States Patent
Hunter

(10) Patent No.: US 8,672,658 B2
(45) Date of Patent: Mar. 18, 2014

(54) VANE PUMP WITH IMPROVED ROTOR AND VANE EXTENSION RING

(75) Inventor: Douglas G. Hunter, Troy, MI (US)

(73) Assignee: SLW Automotive Inc., Sallisaw, OK (US)

( * ) Notice: Subject to any disclaimer, the term of this patent is extended or adjusted under 35 U.S.C. 154(b) by 111 days.

(21) Appl. No.: 13/138,887

(22) PCT Filed: Apr. 21, 2010

(86) PCT No.: PCT/US2010/001183
§ 371 (c)(1),
(2), (4) Date: Oct. 18, 2011

(87) PCT Pub. No.: WO2010/123556
PCT Pub. Date: Oct. 28, 2010

(65) Prior Publication Data

US 2012/0034125 A1 Feb. 9, 2012

Related U.S. Application Data

(60) Provisional application No. 61/214,223, filed on Apr. 21, 2009.

(51) Int. Cl.
*F03C 2/00* (2006.01)
*F03C 4/00* (2006.01)
*F04C 2/00* (2006.01)

(52) U.S. Cl.
USPC ..... 418/260; 418/133; 418/259; 418/268

(58) Field of Classification Search
USPC ..... 418/133, 259–260, 266–268, 270
See application file for complete search history.

(56) References Cited

U.S. PATENT DOCUMENTS

| | | | | |
|---|---|---|---|---|
| 2,282,642 | A * | 5/1942 | Curtis | 418/255 |
| 3,834,846 | A * | 9/1974 | Linder et al. | 418/133 |
| 6,280,150 | B1 | 8/2001 | Miyazawa | |
| 6,790,013 | B2 | 9/2004 | Hunter et al. | |
| 6,896,489 | B2 | 5/2005 | Hunter et al. | |
| 7,018,178 | B2 | 3/2006 | Hunter et al. | |
| 7,396,214 | B2 | 7/2008 | Hunter et al. | |
| 7,674,095 | B2 | 3/2010 | Hunter et al. | |
| 7,726,948 | B2 | 6/2010 | Hunter et al. | |
| 7,997,882 | B2 * | 8/2011 | Shulver et al. | 418/26 |
| 2010/0080724 | A1 | 4/2010 | Jannausch et al. | |
| 2010/0139611 | A1 | 6/2010 | Hunter | |

FOREIGN PATENT DOCUMENTS

| | | | | |
|---|---|---|---|---|
| DE | 32 37 380 | | 4/1983 | |
| DE | 10240409 | | 3/2003 | |
| DE | 102007039172 | A1 * | 12/2008 | F01C 21/08 |
| JP | 58-093978 | | 6/1983 | |
| JP | 2008-303734 | | 12/2008 | |
| WO | 2006/047986 | | 5/2006 | |
| WO | 2007/098595 | | 9/2007 | |
| WO | WO 2008137037 | A1 * | 11/2008 | F04C 14/18 |

* cited by examiner

*Primary Examiner* — Theresa Trieu
(74) *Attorney, Agent, or Firm* — Warn Partners, P.C.

(57) ABSTRACT

A fluid vane pump having a housing with a generally cylindrically walled control volume with an inlet and outlet. A rotor is provided having a rotatable axis within the cylindrical wall control volume. The rotor has a plurality of radially movable vanes operating with the cylindrical wall. A single vane ring is provided which operates with the rotor having an outer radial surface contacting the inner radial edges of the vanes.

14 Claims, 3 Drawing Sheets

VANE PUMP WITH IMPROVED ROTOR AND VANE EXTENSION RING

CROSS-REFERENCE TO RELATED APPLICATIONS

This application is a National Stage of International Application No. PCT/US2010/001183, filed Apr. 21, 2010. This application claims priority to U.S. patent application No. Ser. 61/214,223 filed on Apr. 21, 2009. The disclosures of the above applications are incorporated herein by reference.

FIELD OF THE INVENTION

The present invention relates to fluid vane pumps, especially vane pumps used for pressurized lubrication of internal combustion engines.

BACKGROUND OF THE INVENTION

Virtually all internal combustion engines have some type of internal positive pressure lubrication system. To provide the pressurized oil flow in the lubrication system, many automotive internal combustion engines have relied upon a gerotor type pump. Although gerotor type pumps have proven to be highly reliable, it is desirable to provide a variable displacement vane pump which requires less power draw on the engine in order to improve fuel economy.

SUMMARY OF THE INVENTION

The present invention brings forth a vane pump which includes a housing providing a generally cylindrically walled control volume wherein the control volume has an inlet and outlet. A rotor is provided having a rotatable axis within the cylindrical wall control volume. The rotor receives a plurality of radially movable vanes operatively associated with the cylindrical wall. A single vane ring is provided which is operatively associated with the rotor having an outer radial surface contacting the inner radial edges of the vanes.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
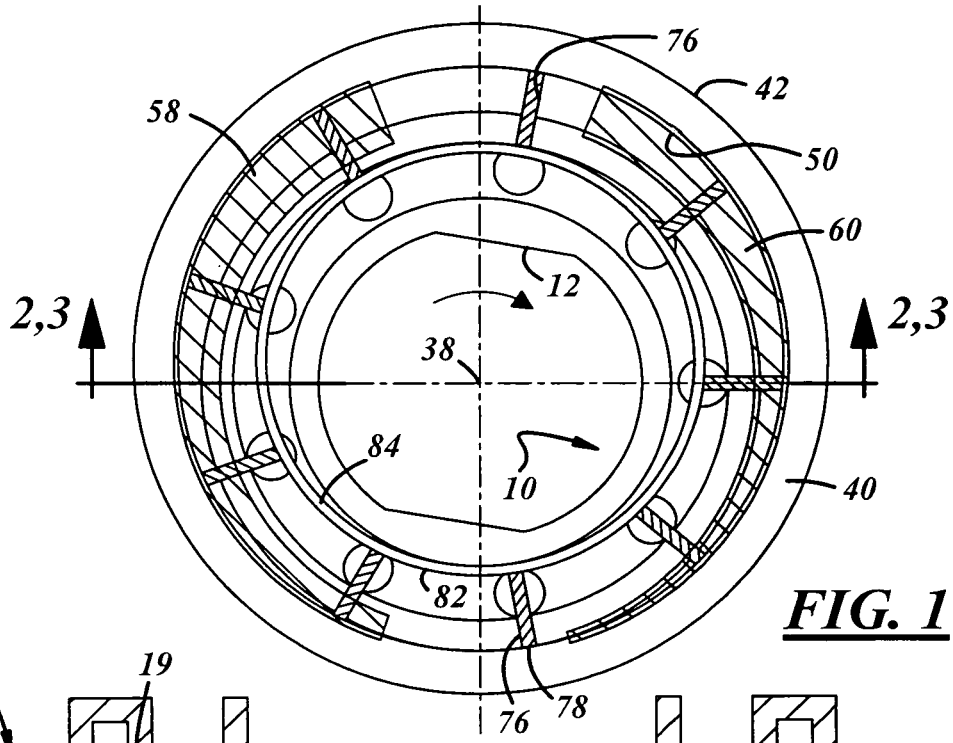
FIG. 1 is a schematic top plan view of a vane pump.
Figure 3:
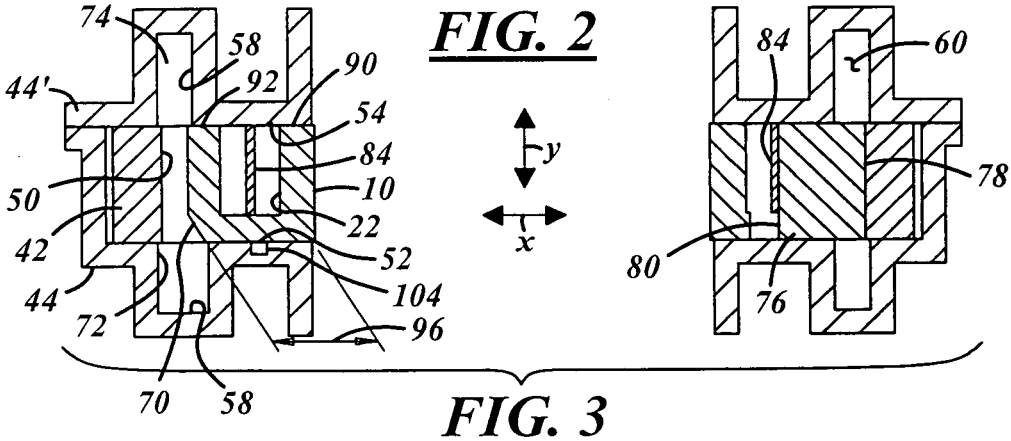
FIG. 3 is a schematic sectional view of a vane pump according to the present invention.
Figure 5:
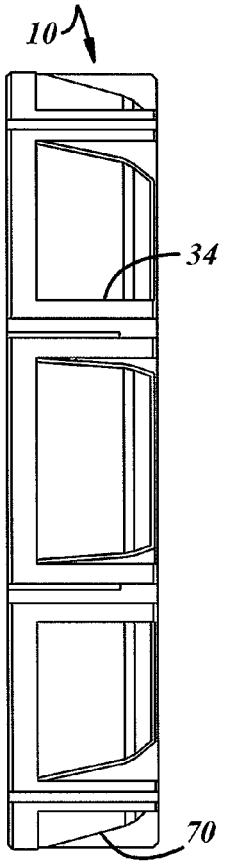
FIG. 5 is a side elevational view of a rotor of a vane pump according to the present invention.
Figure 4:
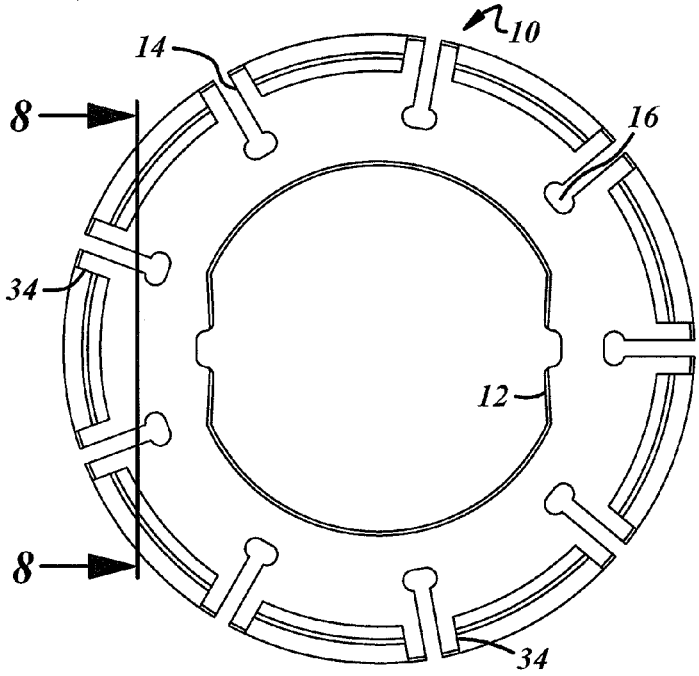
FIG. 4 is a bottom view of a rotor of a vane pump according to the present invention.
Figure 10:
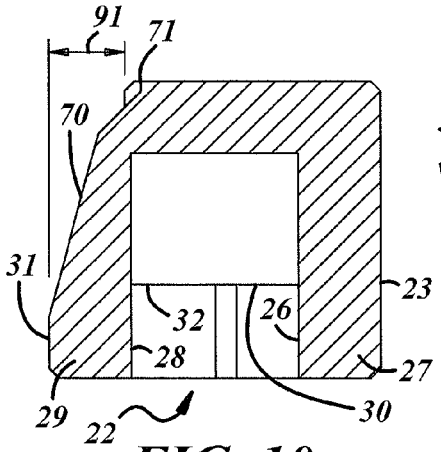
FIG. 10 is a sectional view taken along line 10-10 if FIG. 6.
Figure 6:
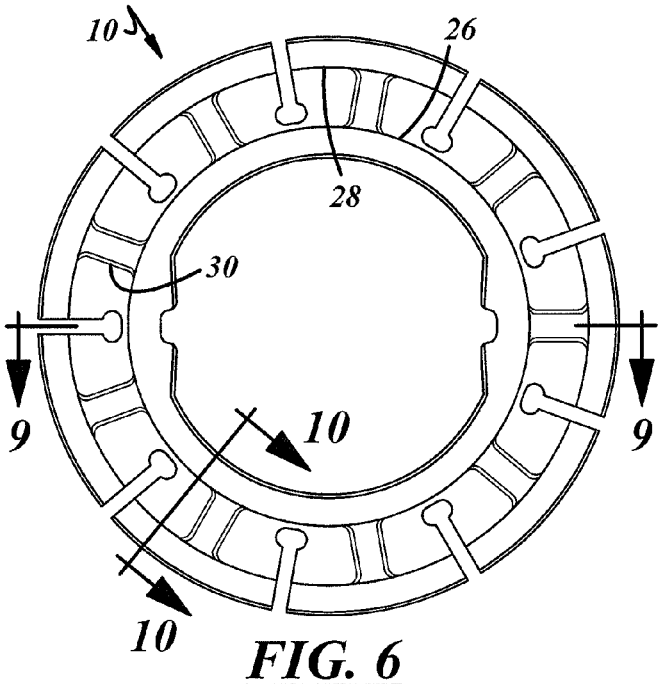
FIG. 6 is a top view of a rotor of a vane pump according to the present invention.
Figure 9:
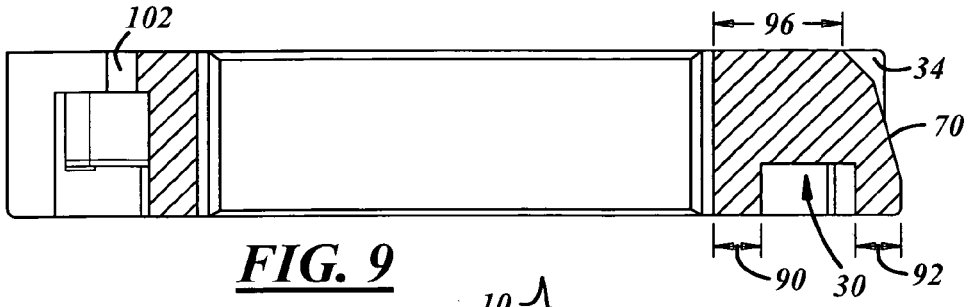
FIG. 9 is a sectional view taken along line 9-9 of FIG. 6.
Figure 8:
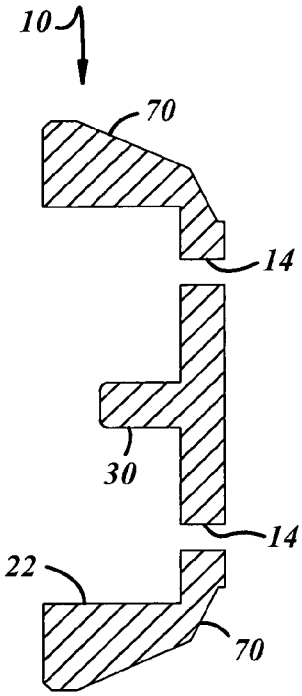
FIG. 8 is a sectional view taken along line 8-8 of FIG. 4.
Figure 7:
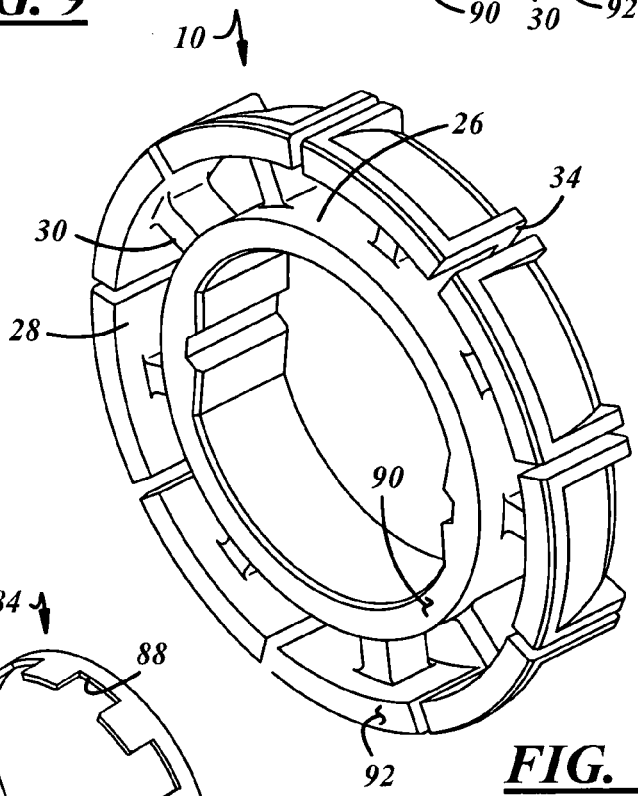
FIG. 7 is a top perspective view of the rotor shown in FIGS. 4-6.
Figure 11:
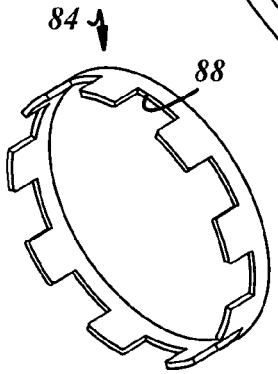
FIG. 11 is a perspective view of a vane ring utilized in the vane pump of the present invention.

Referring to FIGS. 1 and 3, an engine lubrication fluid vane pump according to the present invention has a pump housing or a housing 44, 44', and a generally perpendicular cylindrical rotor 10. The housing 44, 44' is shown as having two portions, but a greater or fewer numbers of portions can be used depending on a particular application. The rotor 10 has an inner diameter with two geometrically opposed flats 12 providing for its connection with a crankshaft of an internal combustion engine. While opposed flats 12 are described, it is possible for other types of connections with the crankshaft to be used. The present exemplary embodiment of the invention describes the connection with a crankshaft of an internal combustion engine; however, possible alternate drive shafts include a balance shaft, camshaft, chain or gear driven pump shaft, and other suitable connections between a pump and an internal combustion engine that include sprockets or splines. The rotor 10 is typically fabricated from powdered metal or other suitable materials, or machined from a solid bar.

Referring now to the Figures generally, the rotor 10 has a plurality of radial slots 14. Each of the radial slots 14 terminates in a cavity 16. The rotor 10 has an axial recess 22 that is generally singular and on one side of the rotor. The recess 22 is located between and partially separates an inner radial wall 27 from an outer radial wall 29 and providing operating space for a vane ring 84. The inner radial wall 27 of the rotor 10 has an outer radial surface 26 and inner surface 23. The outer radial wall 29 has an inner radial surface 28 and an angled outside surface 31. Extending across the axial recess 22 between the inner radial surface 26 and outer radial surface 28 is a series of axial ribs 30, which add rigidity to the rotor's 10 structure. Also, it is within the scope of the invention to not have ribs 30 if not needed for a particular application. The axial ribs 30 have an extreme end 32 which extends only partially the length of the recess 22 allowing space for the vane ring 84. Adjacent the radial slot 14, the rotor has vane supports 34. The rotor has a rotational axis 38. A generally cylindrical wall 50 provided by an eccentric ring 42 is eccentrically positioned with respect to the rotational axis 38. Eccentric ring 42 is position adjustably mounted within the housing 44, 44'. A further explanation of the system for adjusting the position of the eccentric ring 42 within the housing 44, 44' is discussed in U.S. Pat. Nos. 6,896,489 or 6,790,013 or 7,018,178 or 7,396,214 or 7,674,095 or published U.S. Patent Application number 2006/0104823 and published PCT Application number PCT/US2008/005631; all of which are published or issued to Hunter et al., the disclosures of which are hereby expressly incorporated by reference.

A control volume is defined by inner diameter 50, rotor 10 and axially spaced first and second housing surfaces 52, 54. The control volume is further subdivided into individual variable pumping chambers by vanes 76.

The control volume receives and discharges fluid through an arcuate inlet 58 and an arcuate outlet 60 in housing 44, 44'. As shown in FIG. 1, the rotor 10 rotates in a clockwise direction. The inlet 58 is also radially widening in the direction of rotation of the rotor 10. In a generally opposite manner, the outlet 60 is radially thinning in the direction of rotation.

The inlet has a primary side 72 with an optional secondary side 74. The rotor 10 has a compound radial taper 70 along the outer angled surface 31 of the outer radial wall 29 with the taper 70 creating a smaller rotor diameter 71 at the rotor face adjacent the housing inlet port 72. The taper 70 allows the inside edge of the primary port 72 to have a smaller radius for admitting oil to the control volume at a lower tangential velocity. Radially movable within each of the slots 14 of the rotor is a corresponding vane 76. The vanes 76 are generally rectangular in shape having their outer radial end 78 operatively associated with the inner diameter 50 of the eccentric ring. The vanes 76 also have inner radial edge 80 contacting an outer radial edge 82 of a vane ring 84. The vane ring 84 has an axial length to radial thickness ratio of at least 200%. The vane ring 84, at its maximum axial length, extends along a major portion of the axial length of the generally rectangular vane and extends at least 50% of axial length of the vane. Axial length is shown in FIG. 3 as the double arrow labeled "Y" while radial thickness is shown as the double arrow labeled "X". The vane ring 84 has a series of axial slots 88 which are fitted over the axial ribs 30 of the rotor.

The vane pump utilizing the rotor 10 is advantageous over prior vane pumps for several reasons. The taper 70 provides more total fluid admittance area for the inlet. The taper 70 on rotor 10 also allows more of the fluid from the inlet area 72 to enter into the pump at a more radially inward position. This radially inward position, as compared with the inlet 71 of a prior art vane pump 9 shown in FIG. 2, reduces cavitation by reducing the velocity of the fluid necessary to match the velocity of the rotor and vanes when the rotor is spinning at higher rotational speeds; for example, above 3000 rpm.

Figure 2:
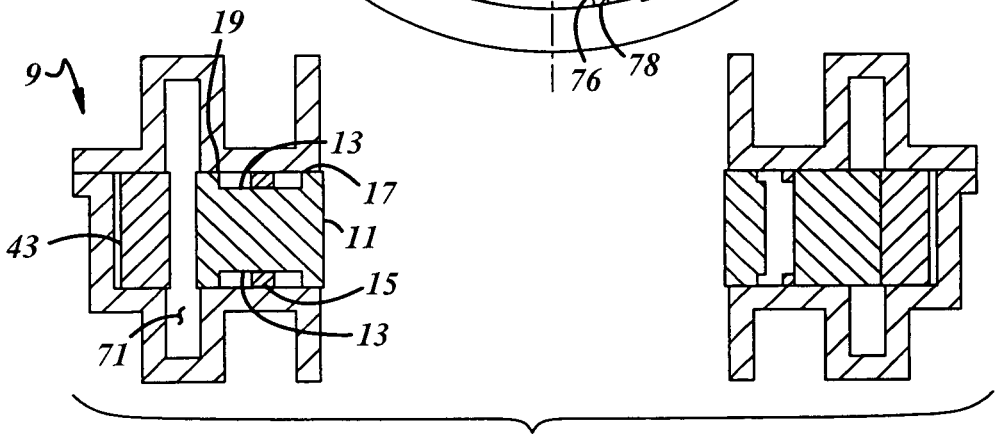
(Prior Art) FIG. 2
FIG. 2 is a schematic sectional view of a prior vane pump.

The rotor 10 also has the aforementioned deeper single recess 22 which causes the rotor 10 to be lighter than its previous rotor 11 with its multiple shallow recesses 13 (FIG. 2). Furthermore, prior art rotor 11 requires two recesses 13 which have placed therein two vane rings 15. Since vane rings 15 were of a generally short axial length, their radial thickness had to be increased to provide rigidity in order to support the vanes 43. The radial thickness of the vane rings 15 increases the diameter of the rotor and the fluid velocity necessary to avoid cavitation, or for a given outer diameter of the rotor 11 decreases the radial thickness of the outer and/or inner radial ends 17 and 19 compared to inner and outer radial ends 90, 92. The additional radial thickness of the radial ends of the rotor 10 improves fluid sealing between the high and low pressure zones of the pump.

Comparing the present invention to the prior art shown in FIG. 2, the axial length of vane ring 84 allows vane ring 84 to be radially thinner than the vane ring 15 but still have the required rigidity. Rotor 10 is allowed to have increased radial thickness of the inner and outer radial ends (axial faces) 90, 92 in the same radial spacing due to the radial thinness of vane ring 84. Since rotor 10 is utilized with only one vane ring 84, one of the recesses 13 of the prior rotor 11 is eliminated, therefore giving a combined seal end length 96 for rotor 10 which again increases sealing capability and pump efficiency. Also, assembly complexity is reduced by eliminating blind assembly placement of one of the two prior vane rings 15.

A path 104 in the housing from the outlet is connected with the area of the rotor adjacent the cavities 16 through a path 102 to allow the vanes to be pressurized in an outward direction. Optional walls 34 further give cantilever support to the vanes 76 and can in some applications aid in sealing between the separate pump chambers divided by the vanes and can also add rigidity to the structure of rotor 10.

Figure 12:
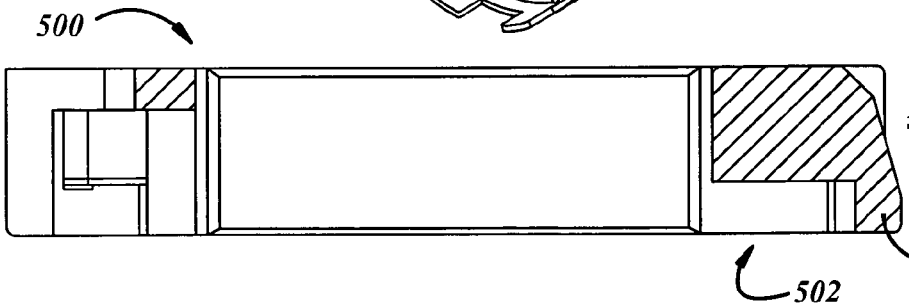
FIG. 12 is a sectional view equivalent to the sectional view taken along line 9-9 of FIG. 6, wherein the sectional view depicts and alternate embodiment of the invention.

FIG. 12 depicts an alternate embodiment of the invention. A rotor 500 is shown having a recess 502 having only a single outer radial wall 504 and no inner radial wall. The use of the alternate recess 502 provides a significant cost savings and material savings and provides additional operating space for the vane ring or allows the rotor diameter to be reduced or the outer radial wall thickness to be increased if it is not necessary to hydraulically separate the recess area 502 from the drive shaft area.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A vane pump comprising:

a housing providing a walled control volume, said housing having an inlet and an outlet;

a rotor having a rotatable axis and a plurality of radially movable vanes slidably connected with said rotor and contained by a cylindrical wall, said cylindrical wall being eccentrically located with respect to said rotatable axis, an outer diameter surface of said rotor is radially tapered along an axial length of said rotor to align with an inner diameter of said housing inlet, said inner diameter being smaller than the largest rotor diameter, wherein said rotor has cavities radially inward of an inner radial end of said vanes and wherein said cavities and an axial recess are pressurized by a path fluidly connected to said outlet;

a single vane ring positioned within the axial recess of said rotor, wherein said single vane ring has an axial length of at least fifty percent of the axial length of said plurality of vanes.

2. The vane pump of claim 1 wherein said pump is an engine lubrication pump and wherein said rotor is connected with an engine crankshaft.

3. The vane pump of claim 1 further comprising an eccentric ring at least partially circumscribing said rotor and movably positioned within said housing between said rotor and said housing.

4. The vane pump of claim 1 wherein said vane ring has a ratio of axial length to radial thickness of at least 200%.

5. The vane pump of in claim 1 wherein said rotor has projecting support walls adjacent said vanes projecting into said taper.

6. A vane pump comprising:

a housing providing a walled control volume, said housing having an inlet and an outlet;

a rotor having a rotatable axis and a plurality of radially movable vanes slidably connected with said rotor and contained by a cylindrical wall, said cylindrical wall being eccentrically located with respect to said rotatable axis, an outer diameter surface of said rotor is radially tapered along an axial length of said rotor to align with an inner diameter of said housing inlet, said inner diameter being smaller than the largest rotor diameter wherein said rotor has ribs between inner and outer radial walls;

a single vane ring positioned within an axial recess of said rotor, wherein said single vane ring has an axial length of at least fifty percent of the axial length of said plurality of vanes and said single vane ring has axial slots to receive ribs of said rotor.

7. A vane pump comprising:

a housing providing a walled control volume, said housing having an inlet and an outlet;

a rotor having a rotatable axis and a plurality of radially movable vanes connectable with said rotor and a cylindrical wall, said cylindrical wall being eccentrically located with respect to said rotatable axis, said rotor being radially tapered along an axial length adjacent said inlet of said housing;

a single recess formed on a surface of said rotor between an inner radial wall and outer radial wall;

a single vane ring positioned within said axial recess of said rotor; and at least one axial rib extending across said recess between said inner radial wall and outer radial wall of said rotor, wherein said single vane ring rests on said at least one axial rib when said single vane ring is positioned within said recess.

8. The vane pump of claim 7 wherein said single vane ring has an axial length of at least 50% of the axial length of said plurality of vanes.

9. The vane pump of claim 7 wherein said pump is an engine lubrication pump and wherein said rotor is connected with an engine crankshaft.

10. The vane pump of claim 7 further comprising an eccentric ring at least partially circumscribing said rotor and movably positioned within said housing between said rotor and said housing.

11. The vane pump of claim 7 wherein said vane ring has a ratio of axial length to radial thickness of at least 200%.

12. The vane pump of claim 7 wherein said rotor has ribs between inner and outer radial walls.

13. The vane pump of in claim 7 wherein said rotor has projecting support walls adjacent said vanes projecting into said taper.

14. A vane pump comprising:

a housing providing a walled control volume, said housing having an inlet and an outlet;

a rotor having a rotatable axis and a plurality of radially movable vanes connectable with said rotor and a cylindrical wall, said cylindrical wall being eccentrically located with respect to said rotatable axis, said rotor being radially tapered along an axial length adjacent said inlet of said housing;

an axial recess formed on a surface of said rotor between an inner radial wall and outer radial wall;

a single vane ring positioned within said axial recess of said rotor, wherein said single vane ring has axial slots to receive ribs of said rotor; and wherein said rotor has cavities radially inward of an inner radial end of said vanes and wherein said cavities and said axial recess are pressurized by a path fluidly connected to said outlet.

* * * * *